US005755441A

United States Patent [19]

Langan et al.

[11] Patent Number: 5,755,441

[45] Date of Patent: May 26, 1998

[54] FOOTBALL BOARD GAME

[76] Inventors: Edward J. Langan; Donna L. Langan, both of 52 Hallberg Ave., Bergenfield, N.J. 07621

[21] Appl. No.: 890,021

[22] Filed: Jul. 10, 1997

[51] Int. Cl.[6] ..... A63F 3/00

[52] U.S. Cl. ..... 273/247

[58] Field of Search ..... 273/242, 243, 273/244, 247, 277

[56] References Cited

U.S. PATENT DOCUMENTS

| | | | |
|---|---|---|---|
| 1,693,277 | 11/1928 | Hustwick | 273/247 |
| 1,701,655 | 2/1929 | Andrews . | |
| 2,454,891 | 11/1948 | Spause | 273/247 |
| 4,094,509 | 6/1978 | Barron | 273/247 |
| 4,285,521 | 8/1981 | Joel, III | 273/247 |
| 4,989,879 | 2/1991 | Nigh . | |
| 5,087,051 | 2/1992 | LoBue | 273/247 |
| 5,158,301 | 10/1992 | Martukovich, Jr. . | |
| 5,451,050 | 9/1995 | Charles . | |
| 5,496,036 | 3/1996 | Chester . | |

*Primary Examiner*—William E. Stoll
*Attorney, Agent, or Firm*—Terrance L. Siemens

[57] ABSTRACT

A board game simulating professional football. The game apparatus includes a board having one hundred individual positions corresponding to the yard lines of the actual game and two scoring zones sandwiching the hundred positions, a marker for indicating position of the offensive player, and several varieties of cards. A menu of available offensive plays is preferably posted on the board. The offensive player selects a play from the menu. The defensive player draws a card associated with the offensive play. A result of each available play is inscribed on the card, and the marker is moved accordingly. If the result is a penalty, the defensive role may elect an outcome revealed on the card, or alternatively, may elect an option to select a second type of card bearing a different result concealed from the players. If the second type of card is elected, then the marker is influenced accordingly. Available plays include simulated yardage gains and losses, scores, possession transitions plays of the actual game.

2 Claims, 3 Drawing Sheets

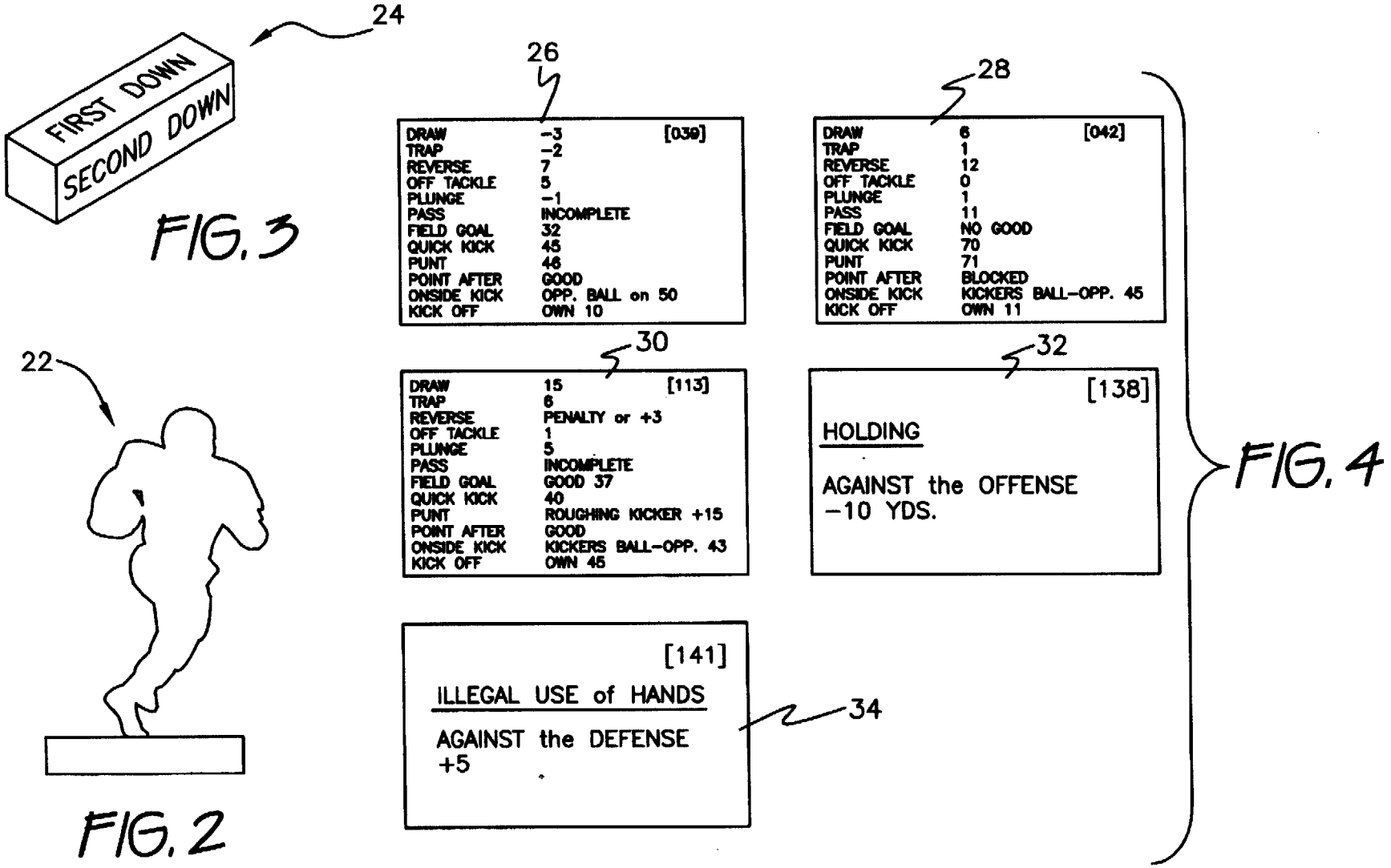
FIG. 4
28
DRAW 6
TRAP 1
REVERSE 12
OFF TACKLE 0
PLUNGE 1
PASS 11
FIELD GOAL NO GOOD
QUICK KICK 70
PUNT 71
POINT AFTER BLOCKED
ONSIDE KICK KICKERS BALL—OPP. 45
KICK OFF OWN 11
[042]
32
[138]
HOLDING
AGAINST the OFFENSE
−10 YDS.
26
DRAW −3
TRAP −2
REVERSE 7
OFF TACKLE 5
PLUNGE −1
PASS INCOMPLETE
FIELD GOAL 32
QUICK KICK 45
PUNT 46
POINT AFTER GOOD
ONSIDE KICK OPP. BALL on 50
KICK OFF OWN 10
[039]
30
[113]
DRAW 15
TRAP 6
REVERSE PENALTY or +3
OFF TACKLE 1
PLUNGE 5
PASS INCOMPLETE
FIELD GOAL GOOD 37
QUICK KICK 40
PUNT ROUGHING KICKER +15
POINT AFTER GOOD
ONSIDE KICK KICKERS BALL—OPP. 43
KICK OFF OWN 45
34
[141]
ILLEGAL USE of HANDS
AGAINST the DEFENSE
+5
24
FIRST DOWN
SECOND DOWN
FIG. 3
22
FIG. 2

FOOTBALL BOARD GAME

BACKGROUND OF THE INVENTION

1. Field of the Invention

The present invention relates to board games, and more particularly to a board game simulating aspects of football. Game apparatus includes a board, one player piece for being moved on the board to indicate progress of the offensive player, a marker piece for indicating the down, and cards bearing instructions determining progress of the player piece along the board.

2. Description of the Prior Art

Football is a popular subject for board games simulating the actual game. Such games are enjoyable since they provide entertainment and enable exercising of skill in understanding football. Football board games typically include a board simulating a football playing field, a marker representing position of the offensive team as it progresses along the board.

A representative game is shown in U.S. Pat. No. 1,701,655, issued to John Harris Andrews on Feb. 12, 1929. In this game, progress of the marker, or the team it represents, is determined by cards. In the game of Andrews, the cards are dealt to the players, and selection of any one card is discretionary. By contrast, controlling cards in the present invention are not subject to selection. Andrews' offensive cards are associated with a quantitative result which is subsequently modified by a defensive card. In the present invention, only one card bears on any one play, and that card solely determines the quantitative result.

U.S. Pat. Nos. 4,989,879, issued to James L. Nigh on Feb. 5, 1991, 5,158,301, issued to Joseph J. Martukovich, Jr., on Oct. 27, 1992, 5,451,050, issued to Eric Charles on Sep. 19, 1995, and 5,496,036, issued to Keith D. Chester on Mar. 5, 1996 further illustrate board games relating to football. However, in these cases, play of the game depends in part on dice, which are not employed in the present invention. Also, other game apparatus and rules of play in this group of prior art football games differ from those of the present invention.

None of the above inventions and patents, taken either singly or in combination, is seen to describe the instant invention as claimed.

SUMMARY OF THE INVENTION

The present invention sets forth a fast paced board game simulating a football game, which is easy to learn and play. In the novel game, a player assuming the offensive role selects a play. The player assuming the defensive role draws a card bearing a plurality of outcomes, there being one outcome for each category of offensive play. Plays are selected from a menu displayed on the board, and include varieties of running plays, passing plays, scoring plays, and possession change plays corresponding to similar actual plays. Most outcomes directly cause a marker representing the offensive team to move along the board. A few outcomes entail penalties which present the defensive player to select between a known outcome posted on the card and an unknown outcome concealed on a different category of cards.

Cards determine each quantitative outcome for each selected play. Initially played cards each bear a plurality of outcomes each relating to one category of selected play. Therefore, dice and other generators of numerical or quantitative results are eliminated. Progress along the board ultimately depends solely upon results printed on the cards.

Play simulates play of the actual game in that progress along the board entitles the offensive team additional plays, or opportunities to make further progress. Crossing into the end of the board constitutes a score equivalent to a touchdown. Simulated field goals, punts, on side kicks, and safeties occur dependent upon player choices and field results.

The game is quickly mastered since most options are set forth in written form, and most results arise from concealed predetermined instructions. Close correlation between the novel game and the actual game allow knowledge of the actual game to bear on making appropriate choices when available. There is no need for knowing details of each player's duties for each play. Therefore, even those having limited knowledge of football can enjoy play.

Accordingly, it is a principal object of the invention to provide a board game generally simulating actual football.

It is another object of the invention that the game proceed based upon uncomplicated, easily mastered steps.

It is a further object of the invention to provide a plurality of outcomes not known to the players for each selected offensive play.

Still another object of the invention is that a single card provide a plurality of outcomes for any selected offensive play, including one outcome for each category of selected play.

An additional object of the invention is to eliminate dice and other generators of numerical outcomes.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein:

FIG. 2 is a side elevational view of game apparatus, namely a marker which is placed on and moved along the board of FIG. 1.

FIG. 3 is a perspective view of game apparatus, namely a down marker for keeping track of duration of a player's turn.

FIG. 4 is a table showing results inscribed upon cards employed in the novel game, the table organized to simulate the cards.

DETAILED DESCRIPTION OF THE PREFERRED EMBODIMENTS

GAME APPARATUS

Figure 1:
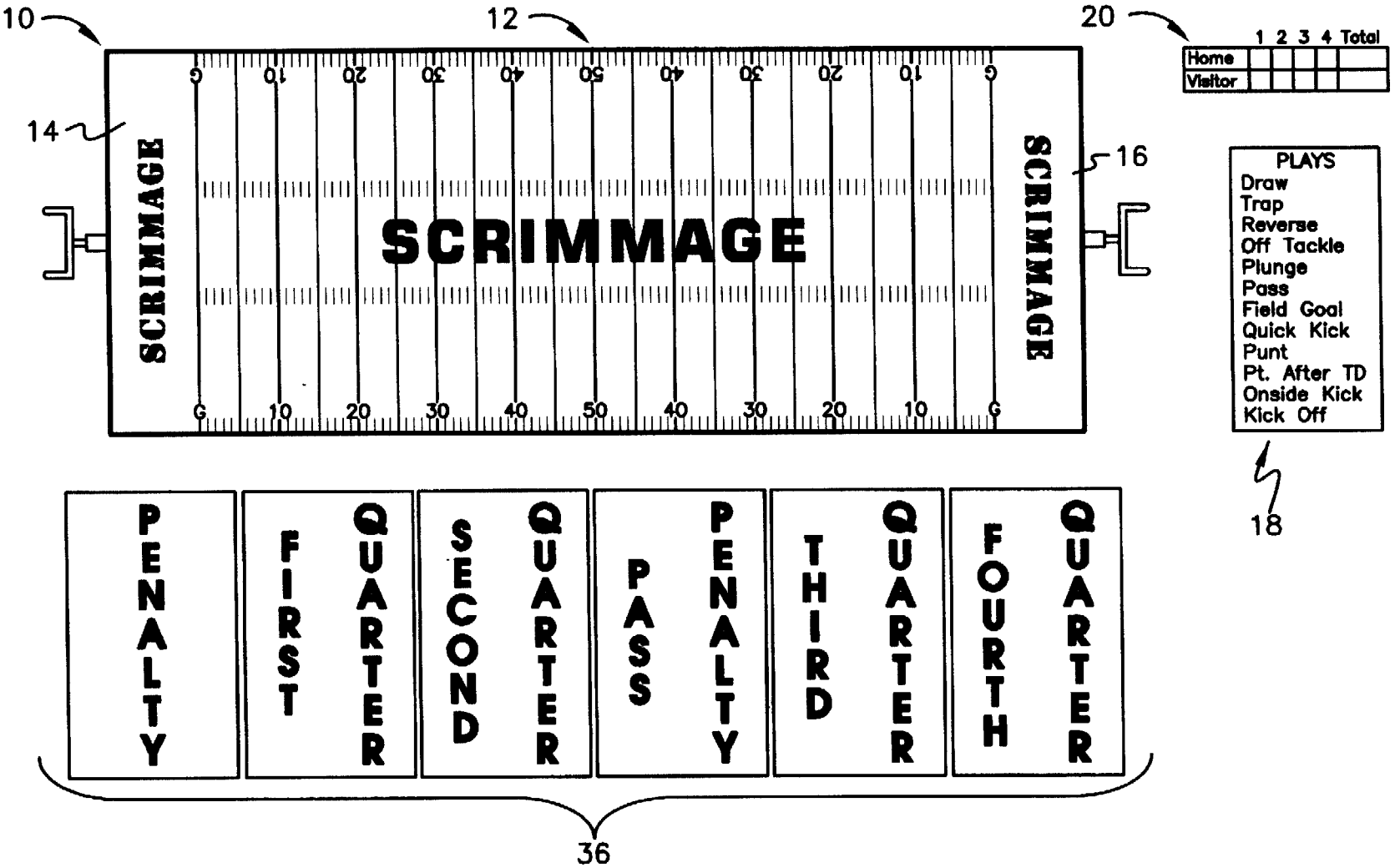
FIG. 1 is a top plan view of the board of the game.

The apparatus of the novel board game simulating football is shown in FIGS. 1, 2, and 3. Turning first to FIG. 1, a board 10 is inscribed with a simulated field, indicated generally by 12, the field including one hundred serially disposed positions for measuring progress along board 10, two end zones each disposed at one end of said simulated field, indicated by 14 and 16 respectively, and a menu indicated at 18 displaying categories of plays which are available for selection.

Menu 18 includes categories of plays including a plurality of yardage plays simulating attempts to gain yardage, including varieties of running and passing plays, at least one play simulating a field goal attempt, and at least one play simulating a possession transition play, such as a punt, a quick kick, a kick off, and an onside kick. Preferably, there are also plays simulating attempt to make a point after touchdown, which of course would follow a successful touchdown. A two point conversion utilizes cards for conventional offensive plays.

Optionally, board 10 has spaces devoted for cards, which will be further described hereinafter, and a table 20 having spaces reserved for entering cumulative scores for each team or player. Table 20 is preferably divided into five spaces for each team, four spaces indicating scoring during each quarter of the game, and the final space showing a total for the entire game.

FIG. 2 illustrates a position marker 22 which is placed on board 10 so as to indicate a particular simulated yard line or the like designating a position. During play, marker 22 is moved forwardly or backwardly, as determined by play. Play simulates the actual game in that each player is afforded turns. A turn at play includes four simulated plays, unless the turn is either terminated as the result of an instruction of a card, or by a score. A down indicator 24, shown in FIG. 3, is provided to assist in remembering how many plays of each turn have been completed. Down indicator 24, as depicted, is a parallelepiped inscribed with indicia corresponding to first, second, third, and fourth downs.

Outcomes of plays are determined by cards, of which there are two general types. Representative cards are illustrated in FIG. 4. The first type of card is a scrimmage card, such as those shown illustratively at 26, 28, and 30. It will be seen that each scrimmage card 26, 28, or 30 is inscribed on only one side with data corresponding to quantitative outcomes of plays, in that yardage gains or losses are indicated for each type of play which may be selected from menu 18 (see FIG. 1) by the player assuming the offensive role. There is one quantitative outcome for each play. Of course, the various cards described above are only illustrative. Outcomes shown thereon may be varied to suit. In the actual game, a considerably greater number of cards of each type are provided, so that a great many simulated plays may be performed in the course of the game, with a wide variety of quantitative outcomes being available. The large number of outcomes is less predictable than would be the case should players play the game so often as to become familiar with the cards.

The second type of card is a penalty card. It will be seen from card 30 that, for example, had a reverse play been selected, it would result in a gain of three yards or positions along board 10, or a penalty. The actual penalty is determined by the penalty cards. A penalty card 34 shows a penalty appropriate for a running play, it being noted that in the example above, the reverse play referred to is a running play. Although it would be possible to have one type of penalty card each inscribed with a predetermined outcome for each type of available play in the manner of the scrimmage cards, it is preferred to segregate the penalty cards into two varieties. These include cards bearing a single penalty appropriate for passing plays, such as card 32, and cards bearing a single penalty appropriate for running plays, such as card 34.

In summary, scrimmage cards are such that each one has inscribed thereon one quantitative outcome for each play which is available for selection by the player assuming the offensive role. At least one scrimmage card includes an outcome offering a choice to a player assuming the defensive role. When the scrimmage card is read, a choice between a known or revealed outcome and a concealed outcome is available. Penalty cards are each inscribed on only one side with data corresponding to second quantitative outcomes which may be selected by the player assuming the defensive role. Preferably, the unused side of each scrimmage and penalty card bears a legend identifying it as a scrimmage, run penalty, or pass penalty card to assure proper selection when the defensive player draws the respective card.

Although not strictly necessary to the game, board 10 (see FIG. 1) is preferably provided with spaces 36 for storing the various cards face down, so that the results are not visible to the players. Each space 36 bears a legend designating the type of card which is to be placed thereon. It is preferred that there be one hundred twenty scrimmage cards, which may be arranged in four equal piles (not shown). The piles correspond to each quarter of an actual game, and serve to introduce the influence of time constraints on scoring at the end of each half of the game, in the manner of an actual game. An appropriate number of spaces 36 are devoted to storing penalty cards. In play, all cards are placed in piles on board 10 with the inscribed outcomes face down.

METHOD OF PLAY

Figure 5:
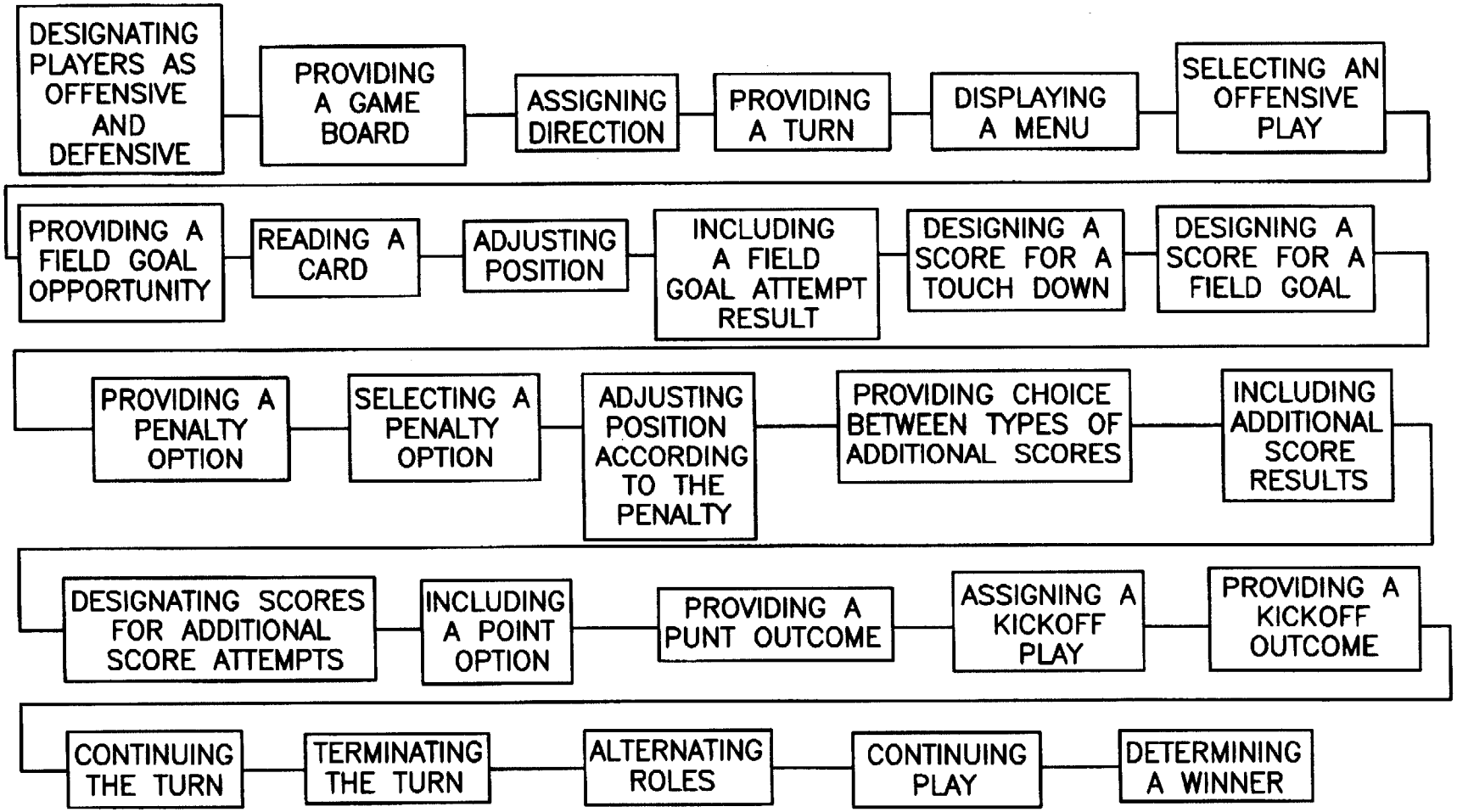
FIG. 5 is a block diagram summarizing steps of playing the novel game, and is read from left to right.

The method of play will now be described, steps of the method being shown in summarized form in FIG. 5. One player is designated as assuming the offensive role, and another player is designated as assuming the defensive role. This may be done by coin toss, as performed in actual games, or in any other way by mutual agreement between the players. The game apparatus described above is provided and suitably arranged for play by piling the cards on board 10 as described above. The player assuming the offensive role is assigned a direction of positive progress along board 10, and an end zone 14 (see FIG. 1) is accordingly designated the offensive scoring position. The defensive role automatically assumes the opposed direction of progress along board 10 and the end zone 14 opposite the offensive end zone 14 is designated the defensive scoring position.

The defensive player chooses a scrimmage card and reads the result associated with the kick off. In the example of card 30 (see FIG. 4), the offensive position would be established at a position associated with its own forty-five yard line. Marker 22 would be placed on the established position. Offensive play would then begin.

The offensive role is compelled to select one of the available offensive plays displayed on the menu at each offensive turn. The defensive player picks one of the scrimmage cards, and reads the result inscribed on the picked scrimmage card corresponding to the chosen offensive play. The position of marker 22 would then be adjusted according to results arising from the outcome borne upon the picked scrimmage card.

Play proceeds according to actual football, in that the offensive player is normally afforded four plays in his turn. The offensive player's turn is continued beyond the four initial plays if a predetermined amount of progress along board 10 is attained, as determined by scrimmage cards played for each offensive play selected, provided that the offensive role is not terminated by an outcome resulting from a picked card. The necessary progress for continuing the turn is preferably ten positions, corresponding to a gain of ten yards from the initial line of scrimmage in the actual game.

Progress may be interrupted by a penalty. It being recalled that at least one scrimmage card bears a penalty option, should this option appear as the result for any selected offensive play, the defensive role is given an option. The defensive role may accept the result of the scrimmage card, or may call for a penalty option in the form of a penalty card to be selected. A penalty card of the appropriate type for the type of offensive play is picked and read. The result inscribed upon the penalty card then determines adjustment of marker 22.

Termination of the turn of the offensive player occurs in any manner similar to that of the actual game, and is determined by scrimmage cards, except where the result of a scrimmage card is modified by a penalty card or by transition situations. Examples transition situations, which are also determined by results indicated on scrimmage cards, include a successful score, a failed scoring attempt, turnovers such as interceptions and fumbles, failure to attain prescribed progress in the first four plays of a turn, a safety, end of the first half of the period of play, and end of the game. Ends of the first half of the period of play and of the game occur when scrimmage cards allocated for these respective periods of play are exhausted.

Successful scoring occurs in a manner corresponding to scoring in the actual game. If the offensive role is able to cause marker 22 to progress successfully to the offensive scoring position, then a first predetermined score is credited to the offensive role. Preferably, this is six points. This situation is followed by providing the offensive role with an opportunity to choose between a first type of additional score and a second type of additional score following successful progress of the offensive role to the offensive scoring position. These first and second additional scores correspond to one- and two-point conversions following a touchdown in the actual game. If the offensive player elects the one-point conversion, then the defensive player picks a scrimmage card and reads the result associated with the point after. In the example of card 30, the attempt is good, and the offensive player is credited with an additional score different from that resulting from that obtained by attaining offensive scoring position 14. If the offensive player elects to attempt a two-point conversion, then he or she selects an offensive play from the menu. The defensive player reads the result for the type of play selected. If the progress indicated is at least three yards, then the attempt is deemed successful, and the offensive player is credited with an additional score different from that obtained by attaining offensive scoring position 14. Since it is desired to simulate actual football, it is preferred that values for a successful touchdown, one-point conversion, and two-point conversion be, respectively, six, one, and two points.

Of course, just as in the manner of actual football, should the defensive player progress to the defensive scoring position, as might result from a simulated turnover, the defensive role attains a predetermined score similar to that which is associated with this occurrence. An opportunity for an additional score, that being a one- or two-point conversion, is afforded to the defensive role, and is carried out in the same manner as for the offensive role.

Just as in the actual game, the offensive role is provided with an opportunity to make a simulated field goal. Each scrimmage card includes a field goal attempt result among the outcomes inscribed thereon. In the example of card 30, a field goal attempted from a distance of twenty-seven positions from the goal line is deemed successful. This calculation is based on the actual game, wherein the goal post is disposed ten yards, which corresponds to ten positions in the novel game, from the goal line. Progress necessary to negotiate the intervening distance between the position occupied by marker 22 and the simulated goal post would then include ten positions plus the number of positions separating marker 22 from the goal line. If marker 22 were between one and twenty-seven positions from the simulated goal line, then progress indicated on the scrimmage card of thirty-seven yards or more would result in a successful field goal attempt. The offensive player would then be awarded a predetermined score value different from that of the first type of score attained when the simulated field goal succeeds. Preferably, the predetermined score value for a successful field goal is three points.

After a successful simulated touchdown, this being achieved by causing the marker to progress to an offensive or defensive scoring position 14, or by achieving a successful field goal attempt, the successful one of the defensive role and the offensive role is assigned to undertake a simulated kick-off play after scoring. Each scrimmage card bears a kick-off outcome terminating the turn of the role which has just scored and initiating a turn of the other role. This situation causes the new offensive role to be positioned at a predetermined distance from an arbitrary predetermined position on the field unrelated to that of the game marker, as noted on the scrimmage card.

As occurs in the actual game, it will frequently come to pass that the offensive player has failed to attain the requisite ten yards to continue his or her turn. He or she then has an option to simulate a punt. Each scrimmage card bears a punting outcome terminating the turn of the offensive role and initiating a turn of the defensive role. This will cause the defensive role and the offensive role to exchange relative roles, and will cause the new offensive role to be positioned at a predetermined distance from the last position of the game marker. A punt performed prior to the fourth play of a turn or of each series of four plays, known as a quick kick in the actual game, may also be performed in the game of the present invention. This option is displayed on menu 18, may be selected by the offensive role, and the results are determined by a scrimmage card. The scrimmage card bears a result preferably different from that displayed for an ordinary punt. In the example of card 30, a quick kick would have the effect of a forty yard punt in that the defensive role would take over possession of the ball some forty positions closer to the defensive scoring position from the prevailing line of scrimmage at the time of the quick kick.

As also may occur in the actual game, a safety is said to occur when the offensive role incurs loss of yardage. This signifies that the result of a selected play, as determined by a scrimmage card, is that the position of marker 22 moves from the field of play in the direction of and occupying or passing through the defensive scoring position. The defensive role is awarded a predetermined score, preferably two points, and the offensive role must kick off to the defensive role as prescribed for kick offs.

The option to simulate an onside kick is available. The player kicking off may select the onside kick, and the result corresponding to this selection is read from the next scrimmage card by the defensive player. Possession and board position are adjusted according to the result from the scrimmage card.

Thus, simulated punting, scoring, and turnovers assure that offensive and defensive roles are alternated in the manner of actual football. Play proceeds for a predetermined play interval, this preferably being determined by the number of scrimmage cards allocated for each time period of play. The winner is determined by summing the score amassed by each player and comparing the amassed scores.

It is to be understood that the present invention is not limited to the embodiments described above, but encompasses any and all embodiments within the scope of the following claims.

We claim:

1. Game apparatus for a board game simulating football, comprising:

a board inscribed with a simulated field including one hundred serially disposed positions for measuring progress along said board, two end zones each disposed at one end of said simulated field, and a menu setting forth categories of plays which are available for selection by a player assuming an offensive role;

a plurality of first cards each inscribed with data corresponding to first quantitative outcomes of plays, there being one first quantitative outcome for each said play which is available for selection by the player assuming the offensive role inscribed upon each said first card, some of said first quantitative outcomes offering choices to a player assuming a defensive role, said choices including a first option of a revealed quantitative outcome and a second option of a concealed second quantitative outcome; and a plurality of second cards each inscribed with data corresponding to second quantitative outcomes which may be selected by the player assuming the defensive role.

2. The game apparatus according to claim 1, said categories of plays including a plurality of yardage plays simulating attempts to gain yardage, at least one play simulating a field goal attempt, and at least one play simulating a possession transition play.

* * * * *